US012708204B1

(12) United States Patent
Walling

(10) Patent No.: US 12,708,204 B1
(45) Date of Patent: Aug. 18, 2026

(54) COLLAPSIBLE SUPPORT DEVICE

(71) Applicant: H. Bennett Walling, Redington Shores, FL (US)

(72) Inventor: H. Bennett Walling, Redington Shores, FL (US)

( * ) Notice: Subject to any disclaimer, the term of this patent is extended or adjusted under 35 U.S.C. 154(b) by 121 days.

(21) Appl. No.: 19/293,099

(22) Filed: Aug. 7, 2025

(51) Int. Cl.
*A47B 91/00* (2006.01)
*A47B 91/12* (2006.01)

(52) U.S. Cl.
CPC ..... *A47B 91/12* (2013.01); *A47B 91/005* (2013.01)

(58) Field of Classification Search
None
See application file for complete search history.

(56) References Cited

U.S. PATENT DOCUMENTS 1,835,714 A * 12/1931 Mccausland ..... G09F 1/06 248/174
3,836,104 A * 9/1974 Miller ..... A47F 5/114 248/150
4,582,283 A * 4/1986 Schmitt ..... A47F 5/114 211/132.1
5,501,158 A * 3/1996 Cheney ..... B25H 1/04 108/165
5,884,568 A * 3/1999 Dombroski ..... A47B 5/04 108/189
6,412,743 B1 * 7/2002 Fell ..... A47F 5/10 40/607.1
6,446,921 B1 * 9/2002 Maschhoff ..... A47F 3/142 108/165
9,395,035 B2 7/2016 Klinzmann
9,901,174 B1 * 2/2018 Conrad ..... A47B 97/08
10,064,482 B2 9/2018 Leafgren
10,718,465 B2 7/2020 Wall
12,233,296 B1 2/2025 Lin
2004/0124324 A1 * 7/2004 Reed ..... A47B 87/0207 248/146
2009/0206211 A1 8/2009 Goodman
2020/0342794 A1 * 10/2020 Dalton ..... A47B 97/08

* cited by examiner

*Primary Examiner* — Steven M Marsh
(74) *Attorney, Agent, or Firm* — Nathan P. Suedmeyer

(57) ABSTRACT

The collapsible support device for supporting objects above an underlying surface includes a collapsible base having a plurality of side panels making it easy to store or transport the stand in a collapsed state. The side panels of the base are configured such that the base transitions between the collapsed state and a supporting state. When the base is in the supporting state, the stand provides support for objects above an underlying surface. This allows a user to deploy support stands under objects elevating the objects above the underlying surface that may potentially flood.

20 Claims, 15 Drawing Sheets

COLLAPSIBLE SUPPORT DEVICE

FIELD

This invention relates to the field of support stands and more particularly to a collapsible device for supporting objects above an underlying surface that can be easily stored and transported when not in use.

BACKGROUND

Stable support of an object above an underlying surface is necessary across various applications and industries, such as storage, warehousing, temporary installations, and emergency preparedness.

In emergency preparation of severe weather events that may cause flooding, objects such as household items, furniture, or business assets benefit from being elevated above the floor or ground to prevent the objects from being damaged by floodwaters.

In emergency preparedness, elevating and supporting objects above an underlying surface can be challenging because often a large number of support structures are needed to elevate and support all vulnerable objects. For emergency applications, support stands must be rapidly deployable, as weather events often provide limited advance warning, yet the stands must also be easily stored when not needed.

What is needed is a device that supports objects above an underlying surface, stores compactly when collapsed, includes features to handle environmental challenges such as flooding, and is optionally capable of interconnection with other support devices to provide modular support configurations for various applications.

SUMMARY

The collapsible support device includes a collapsible base having a plurality of side panels making it easy to store or transport the stand in a collapsed state. The side panels of the base are configured such that the base transitions between the collapsed state and a supporting state. When the base is in the supporting state, the stand provides support for objects above an underlying surface. Optionally, a removable cap fits within an opening at the top of the base when erected, providing structural reinforcement to maintain the base in the supporting state. The device is particularly useful for emergency preparedness applications where objects need rapid elevation above potentially floodable surfaces.

Objects requiring support above an underlying surface may be household items, furniture, tangible business assets, goods, inventory items, or any object that may be protected from floodwaters by elevating the object. By elevating and supporting the object with the stand, the object may be protected from floodwaters due to the additional elevation of the object even if the underlying surface floods. The stand is comprised of materials and features that support the object above the underlying surface without the stand being displaced or compromised when exposed to winds, water, or flooding.

In the preferred embodiment, the base of the stand is substantially the shape of a truncated square pyramid when in the supporting state. In the supporting state, the side panels form an opening at a top portion of the base. The preferred embodiment includes a removable cap. The cap includes a lower portion configured to fit within the opening and an upper portion that abuts the top edges of the side panels. The cap provides structural reinforcement for the base, preventing the side panels from collapsing while the cap is in place. The truncated square pyramid shape of the base provides a stable, wide base for support while allowing easy load centering at the smaller top opening.

In alternative embodiments, the base of the stand includes one or more base vents formed as an aperture in a side panel. The base vent allows fluids to pass through the side panel. The base vent reduces displacement forces caused by wind or water against the side panels of the base. In some embodiments, at least one base vent is sized to receive and store the cap, preventing loss of the cap during storage, transport, or when the cap is not in use.

Alternative embodiments optionally include one or more cap vents formed as an aperture in the cap. The cap vent allows fluid communication between the interior of the base and the external environment. The cap vent reduces environmental displacement forces against the stand by allowing pressure equalization and fluid drainage.

Alternative embodiments optionally include a notch in the top of one or more side panels. The notch can serve as a vent near or at the top of the base to reduce displacement forces. The notch is optionally configured to receive a beam. One example of a beam is a lumber piece that may be positioned in the one or more notches. However, the beam may be any structure capable of being positioned in the one or more notches and capable of providing support for objects positioned on the beam. In some embodiments non-adjacent or opposite facing side panels may each include notches that enable the positioning of the beam to span the opening at the top portion of the base as an alternative to the cap. In these embodiments, the beam provides support for the object above the underlying surface and structural reinforcement for the base in the supporting state.

In some embodiments, the base may be configured such that a beam may be positioned in notches on more than one base and span an area between the bases. Support of the object may be provided by placing the object on the beam even if the base is not positioned directly underneath the object or when the cap is not positioned on the base.

In alternative embodiments the side panels are connected by one or more hinges that enable the folding action between collapsed and supporting states. The hinge may be any jointed or flexible device enabling transition of the base between the collapsed state and the supporting state, including mechanical hinges, living hinges, or hinges made of resilient flexible material. Alternative base shapes may be used such as a substantially rectangular prism shape or any shape that maintains the collapsible functionality of the base.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
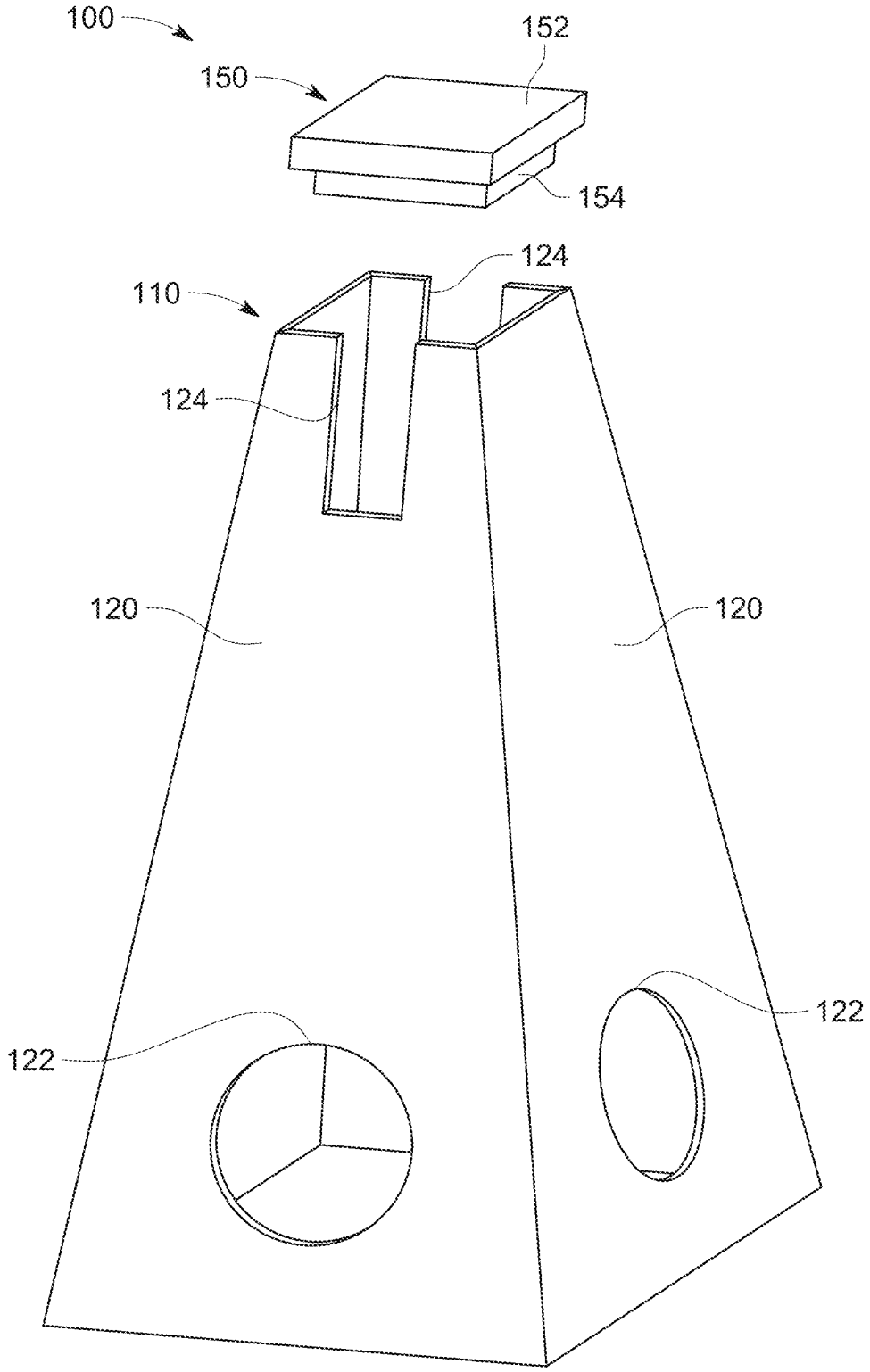
FIG. 1 illustrates an isometric view of a first embodiment of the stand.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an isometric view of a first embodiment of the stand is shown. The stand 100 includes a base 110 and a cap 150. The cap 150 is formed from an upper portion 152 affixed to a lower portion 154. The base 110 is formed from a plurality of side panels 120. A side panel 120 may include a base vent 122 and may include a notch 124.

Figure 2:
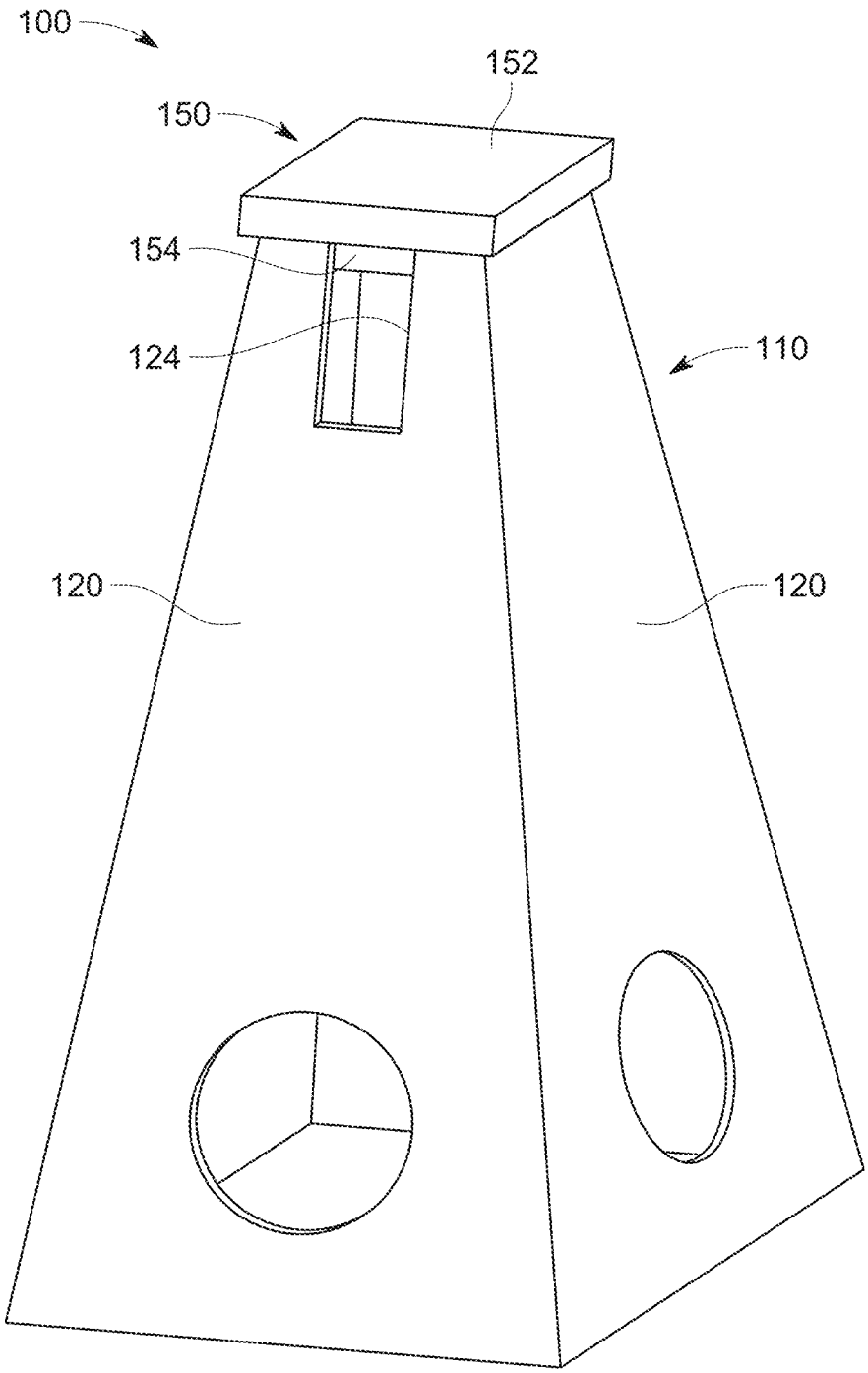
FIG. 2 illustrates an isometric view of the first embodiment of the stand in its supporting state with the cap positioned on top of the base.

Referring to FIG. 2, an isometric view of the first embodiment of the stand in its supporting state with the cap positioned on top of the base is shown. The stand 100 is shown in its supporting state with the cap 150 positioned on top of the base 110. The cap 150 is positioned on top of the base 110 such that the upper portion 152 abuts the top edges of the plurality of side panels 120 and above the notch 124. The lower portion 154 is inside the perimeter formed by the top edges of the plurality of side panels 120, thereby providing structural reinforcement that maintains the base 110 in its supporting state and prevents collapse of the side panels 120.

Figure 3:
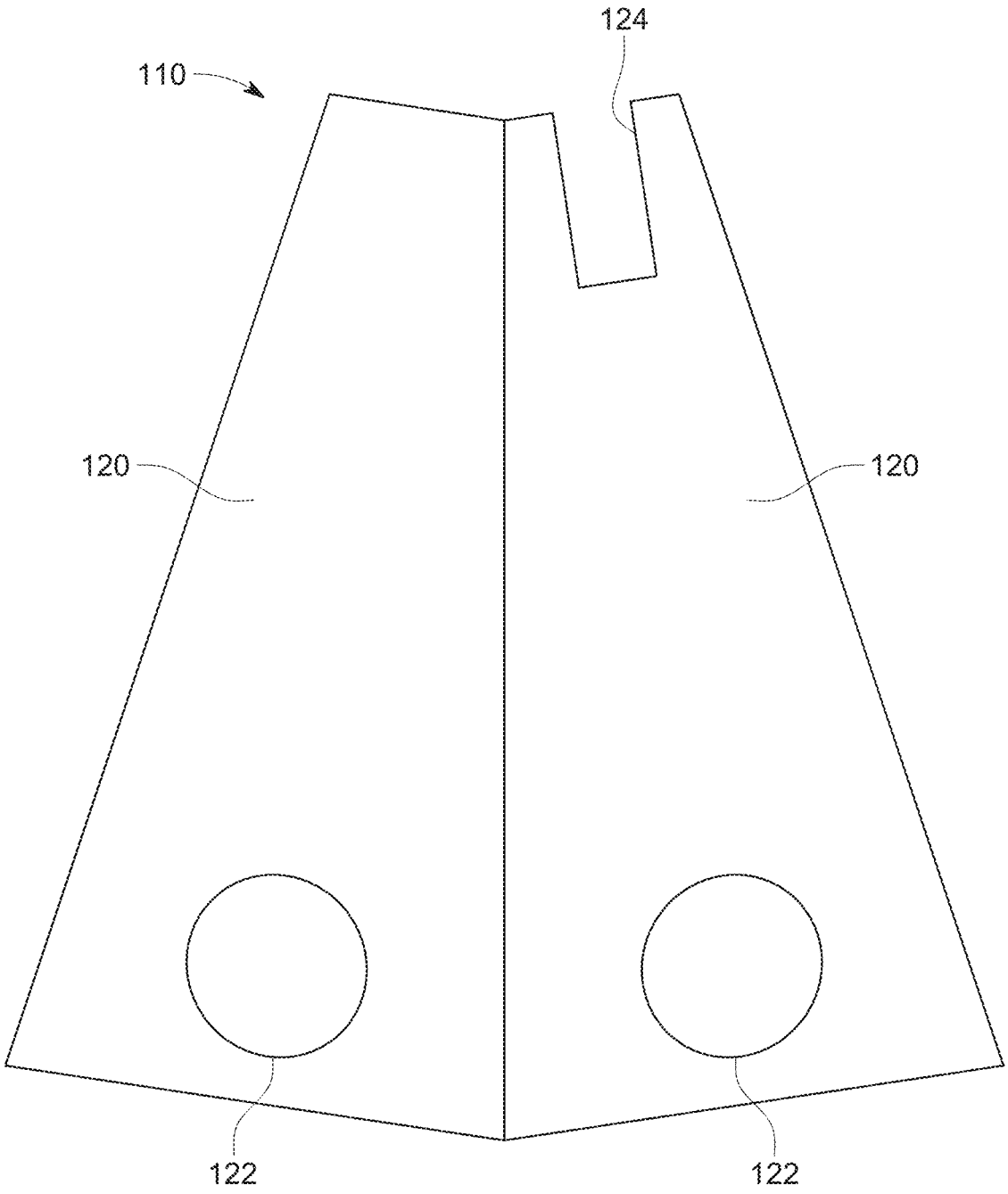
FIG. 3 illustrates an overhead view of the base of the first embodiment of the stand in its collapsed state.

Referring to FIG. 3, an overhead view of the base of the first embodiment of the stand in its collapsed state is shown. The base 110 is shown in its collapsed state with the base 110 folded such that the face of a side panel 120 abuts the face of another side panel 120. A side panel 120 may include a base vent 122 and may include a notch 124.

Figure 4:
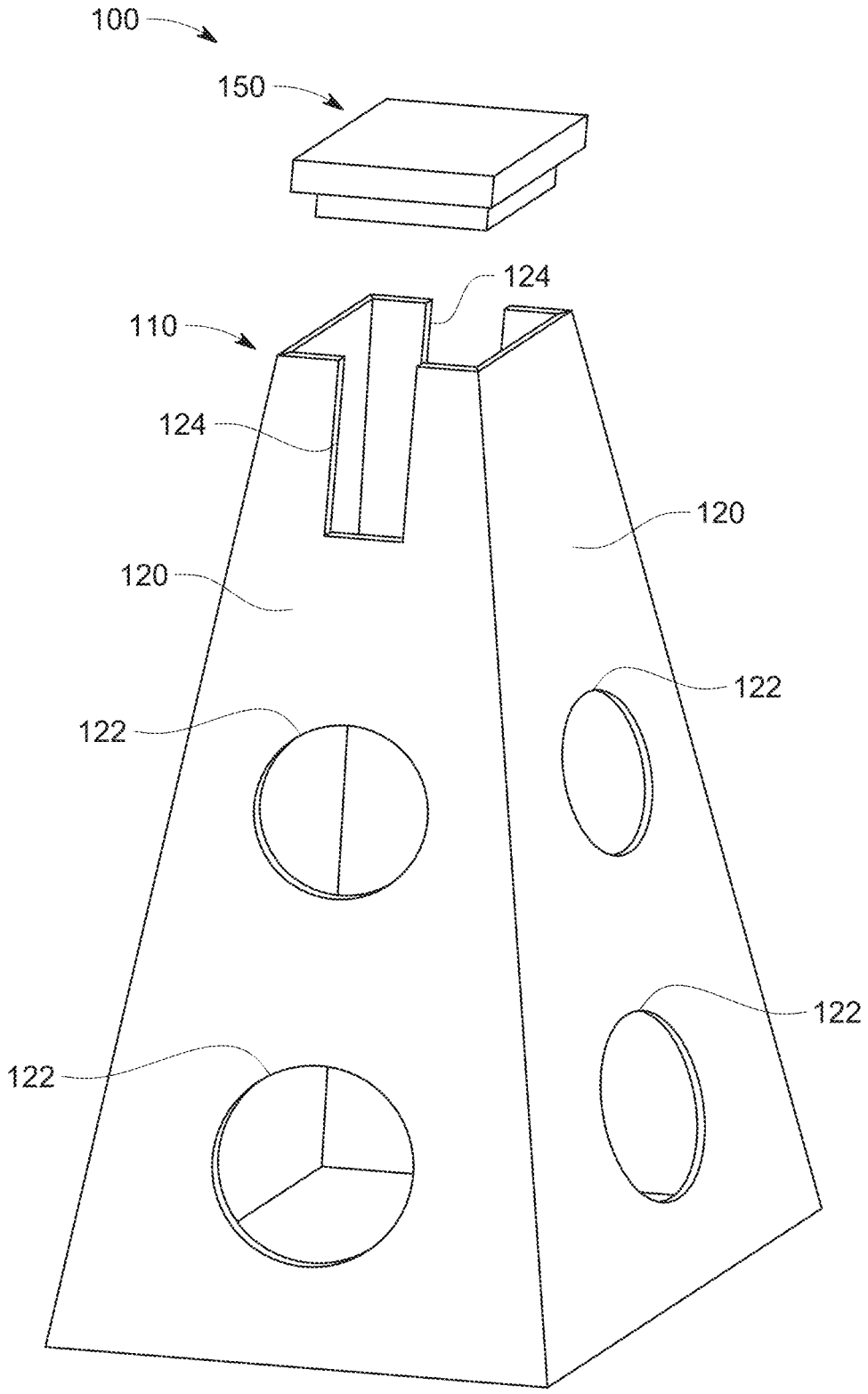
FIG. 4 illustrates an isometric view of a second embodiment of the stand.

Referring to FIG. 4, an isometric view of a second embodiment of the stand is shown. The stand 100 includes a base 110 and a cap 150. The base 110 is formed from a plurality of side panels 120. A side panel 120 may include more than one base vent 122 and may include a notch 124.

Figure 5:
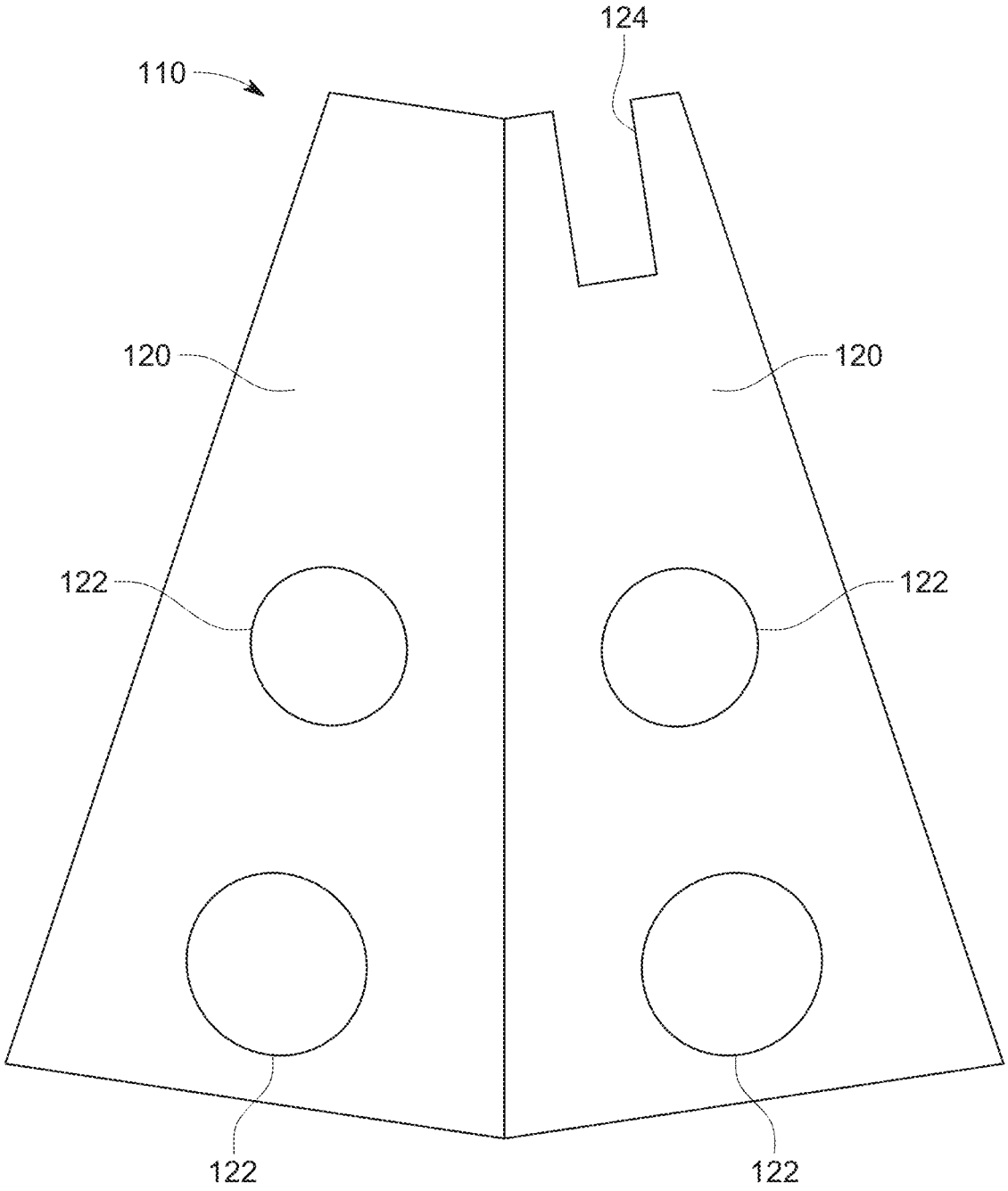
FIG. 5 illustrates an overhead view of the base of the second embodiment of the stand in its collapsed state.

Referring to FIG. 5, an overhead view of the base of the second embodiment of the stand in its collapsed state is shown. The base 110 is shown in its collapsed state with the base 110 folded such that the face of a side panel 120 abuts the face of another side panel 120. A side panel 120 may include more than one base vent 122 and may include a notch 124.

Figure 6:
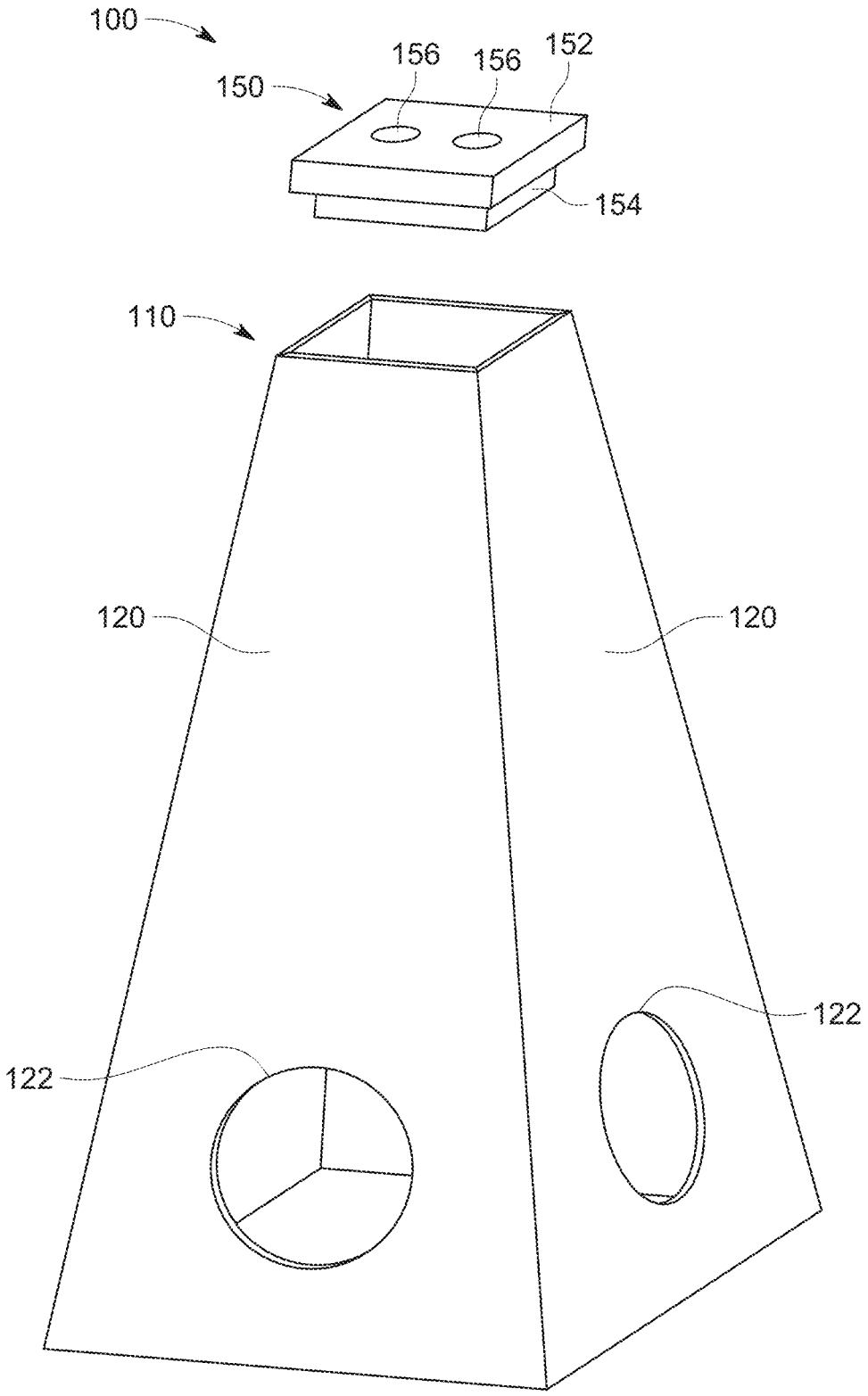
FIG. 6 illustrates an isometric view of a third embodiment of the stand.

Referring to FIG. 6, an isometric view of a third embodiment of the stand is shown. The stand 100 includes a base 110 and a cap 150. The cap 150 is formed from an upper portion 152 affixed to a lower portion 154. The cap 150 includes at least one cap vent 156 through the upper portion 152 and lower portion 154. The base 110 is formed from a plurality of side panels 120. A side panel 120 may include a base vent 122. The cap vent 156 and base vent 122 allow fluid communication between the interior of the base 110 and the external environment, reducing displacement forces upon the stand 100, especially during extreme weather events, such as flooding or high wind conditions.

Figure 7:
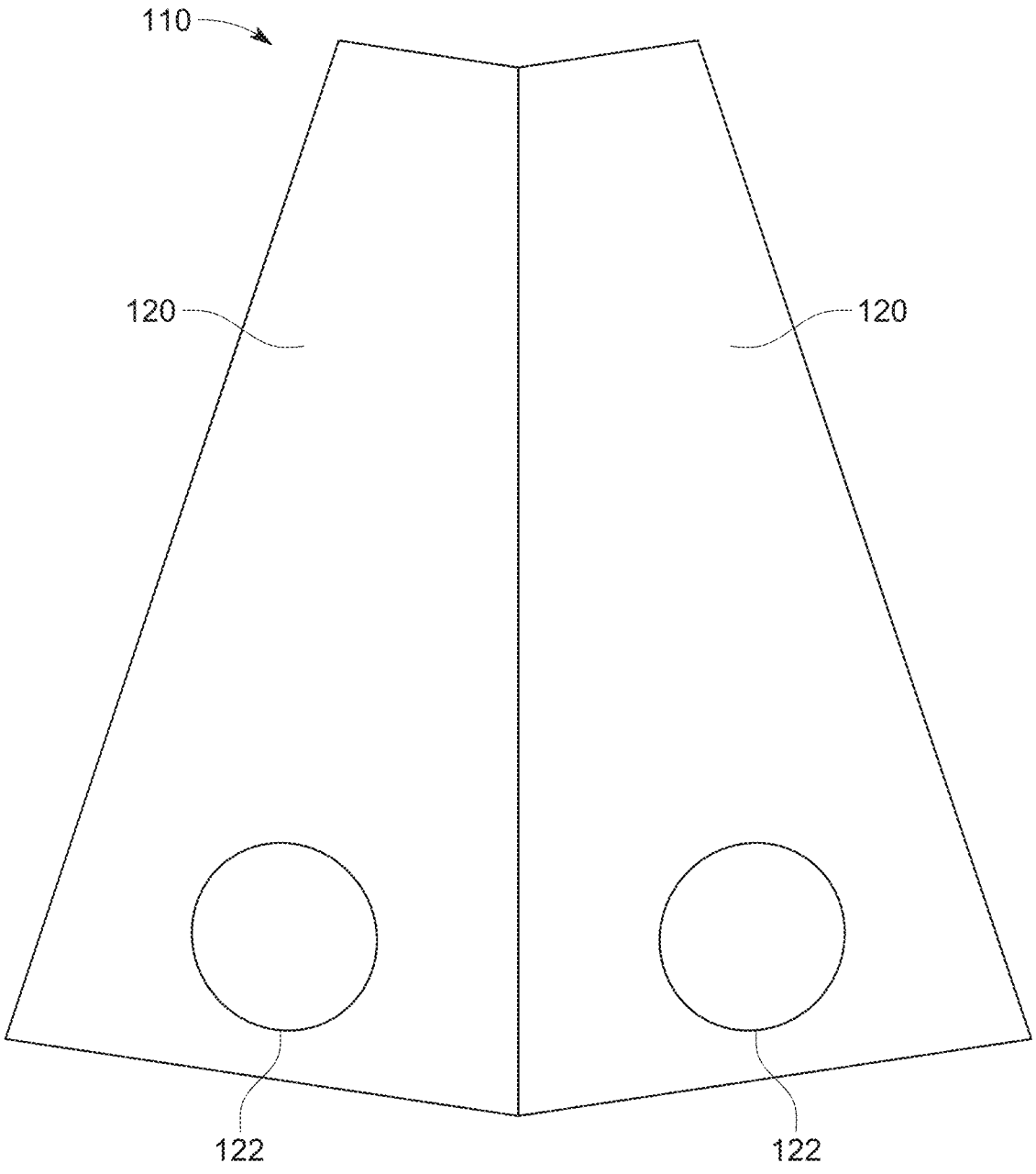
FIG. 7 illustrates an overhead view of the base of the third embodiment of the stand in its collapsed state.

Referring to FIG. 7, an overhead view of the base of the third embodiment of the stand in its collapsed state is shown. The base 110 is shown in its collapsed state with the base 110 folded such that the face of a side panel 120 abuts the face of another side panel 120. A side panel 120 may include a base vent 122.

Figure 8:
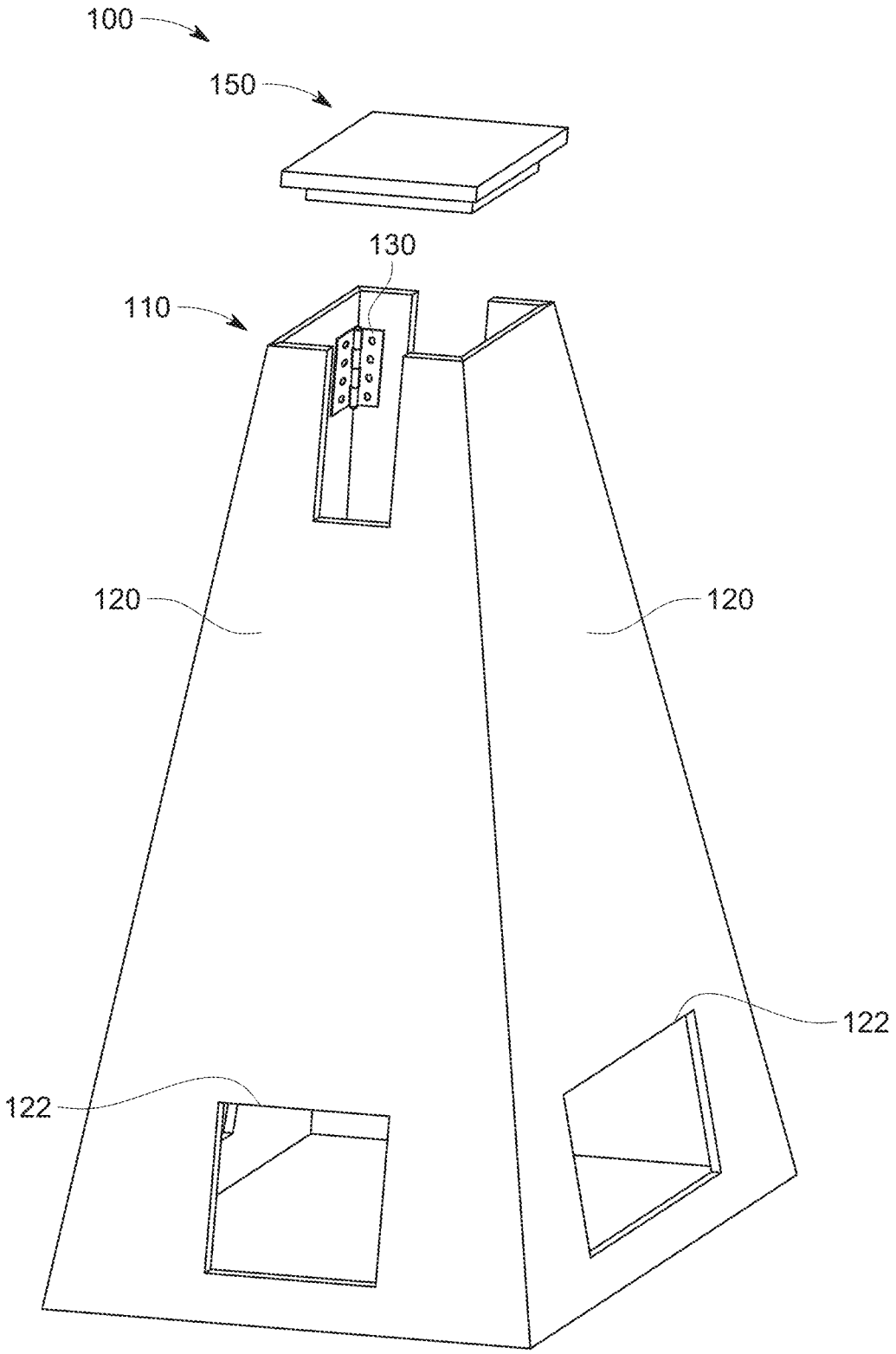
FIG. 8 illustrates an isometric view of a fourth embodiment of the stand.

Referring to FIG. 8, an isometric view of a fourth embodiment of the stand is shown. The stand 100 includes a base 110 and a cap 150. The base 110 is formed from a plurality of side panels 120. A side panel 120 may include a square-shaped base vent 122 and may include a notch 124. The edge of a side panel 120 is connected to the edge of an adjacent side panel 120 with a hinge 130, enabling the base 110 to transition between the collapsed state and supporting state.

The stand 100, including base 110, side panels 120, and cap 150 may be constructed from various materials including, but not limited to, plastic, metal, wood, composite materials, or any suitable material capable of supporting loads. The hinges 130 may be integrally molded with the side panels 120 or separately attached depending on the manufacturing method and material selection.

Figure 9:
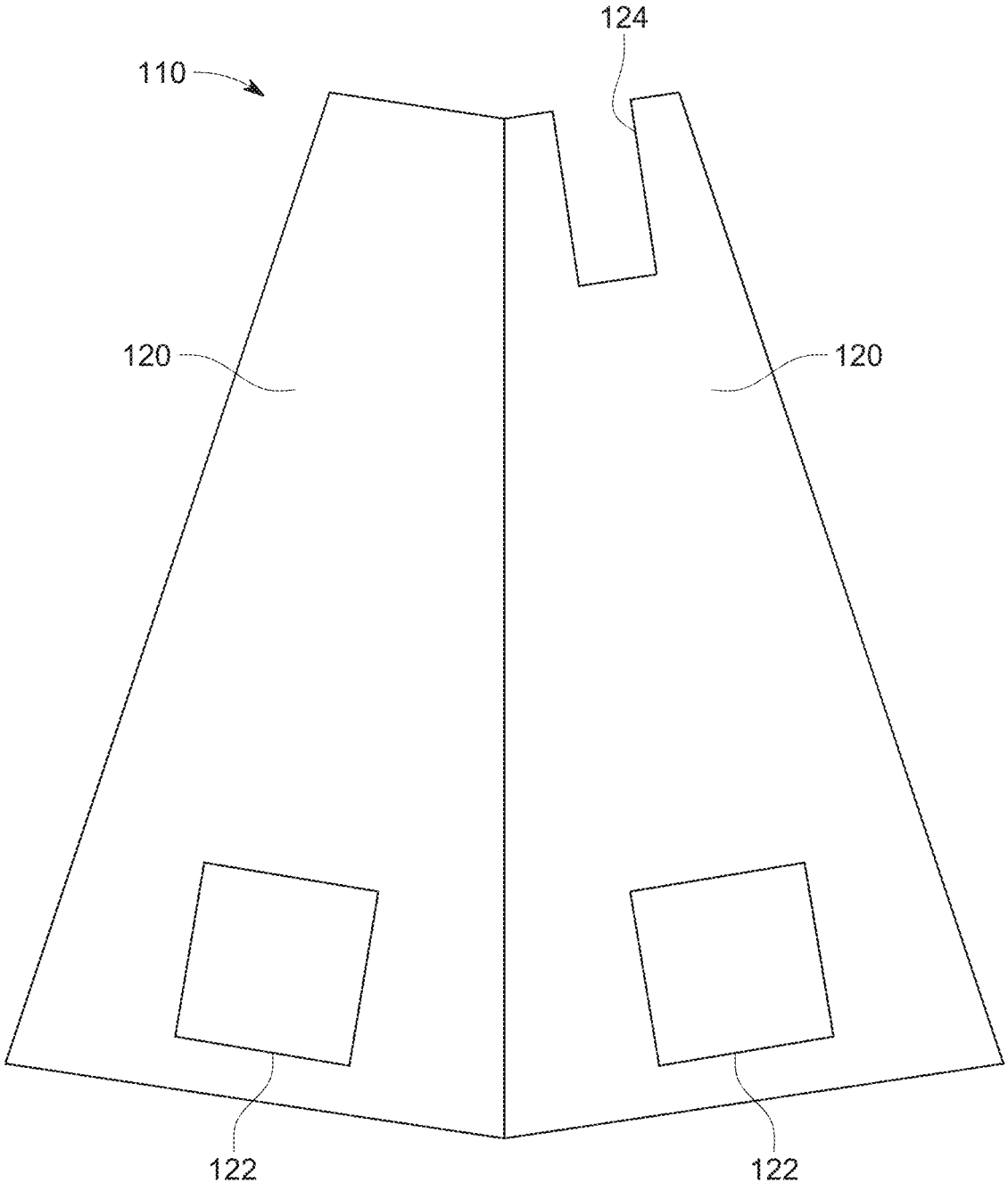
FIG. 9 illustrates an overhead view of the base of the fourth embodiment of the stand in its collapsed state.

Referring to FIG. 9, an overhead view of the base of the fourth embodiment of the stand in its collapsed state is shown. The base 110 is shown in its collapsed state with the base 110 folded such that the face of a side panel 120 abuts the face of another side panel 120. A side panel 120 may include a square-shaped base vent 122 and a notch 124.

Figure 10:
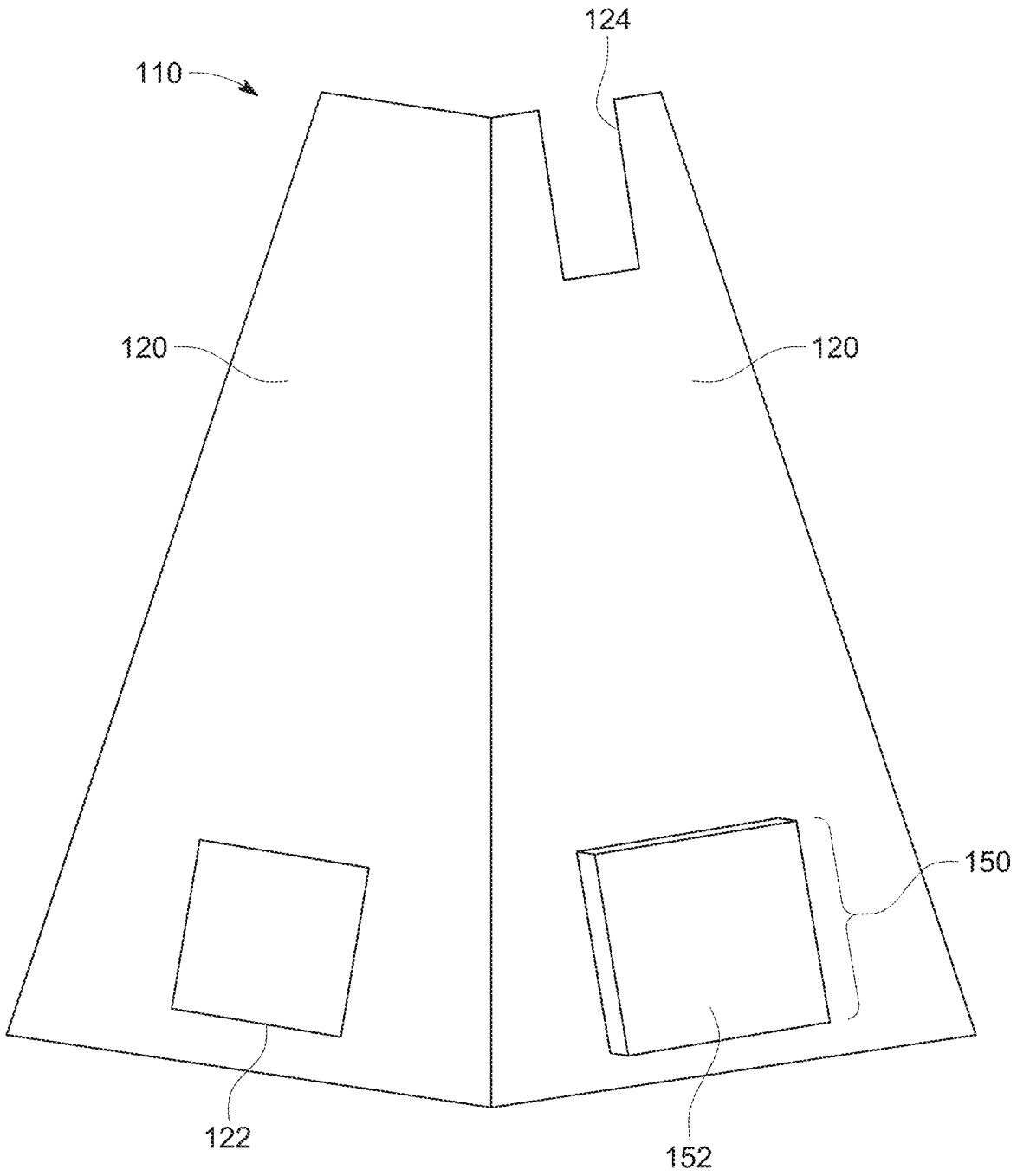
FIG. 10 illustrates an overhead view of the fourth embodiment of the stand in its collapsed state with the cap positioned on a base vent.

Referring to FIG. 10, an overhead view of the fourth embodiment of the stand in its collapsed state with the cap positioned on a base vent is shown. The base 110 is shown in its collapsed state with the base 110 folded such that the face of a side panel 120 abuts the face of another side panel 120. A side panel 120 may include a square-shaped base vent 122 and a notch 124. The square-shaped base vent 122 may be sized such that the cap 150 can be stored in the base vent 122 with the lower portion of the cap 150 fitting inside the perimeter of the base vent 122 and the upper portion 152 of the cap 150 abutting to the outer face of the side panel 120.

Figure 11:
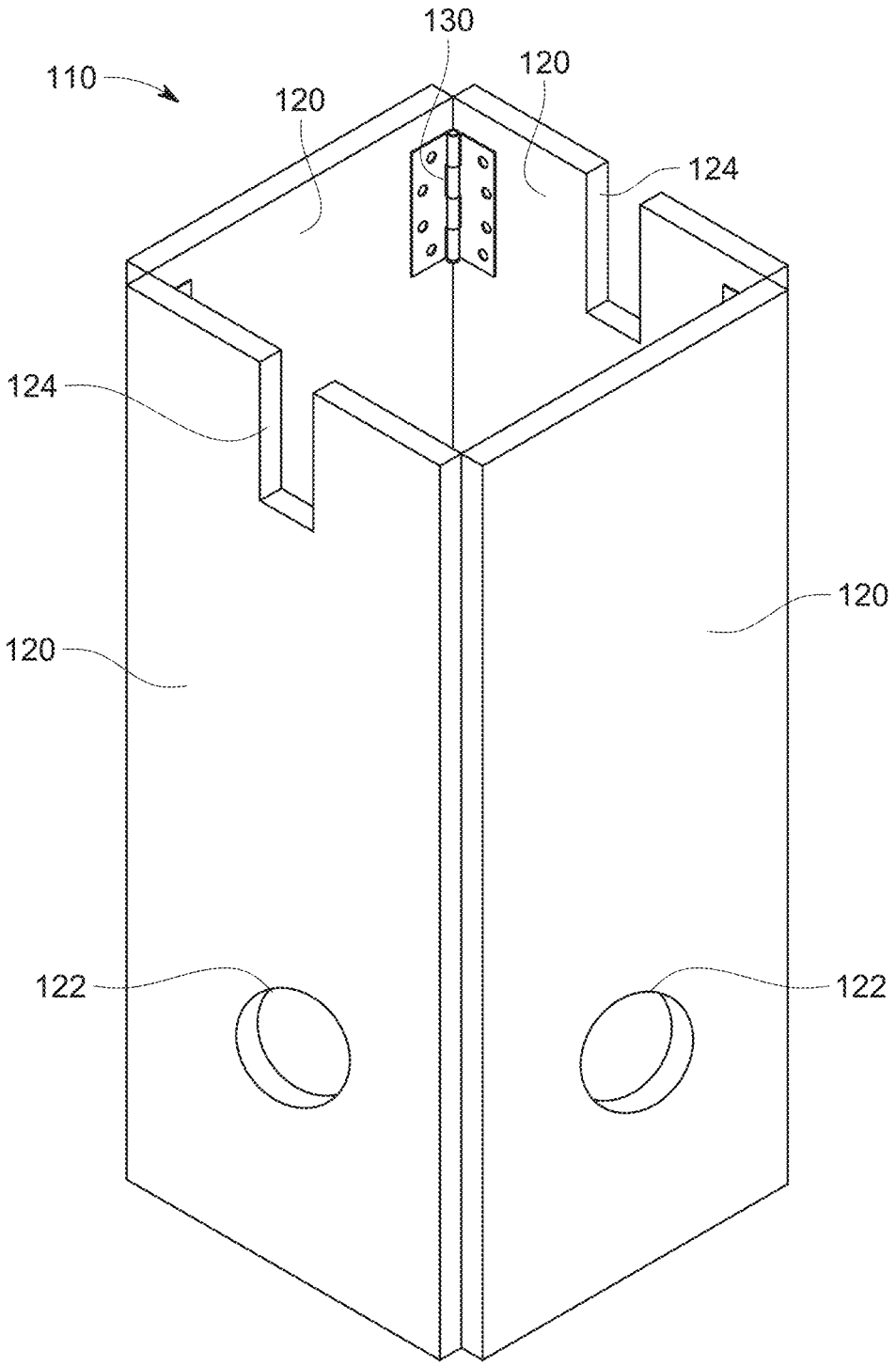
FIG. 11 illustrates an isometric view of a fifth embodiment of the base of the stand.

Referring to FIG. 11, an isometric view of a fifth embodiment of the base of the stand is shown. The base 110 is formed from a plurality of side panels 120. A side panel 120 may include a base vent 122 and may include a notch 124. The edge of a side panel 120 is connected to the edge of an adjacent side panel 120 with a hinge 130.

Figure 12:
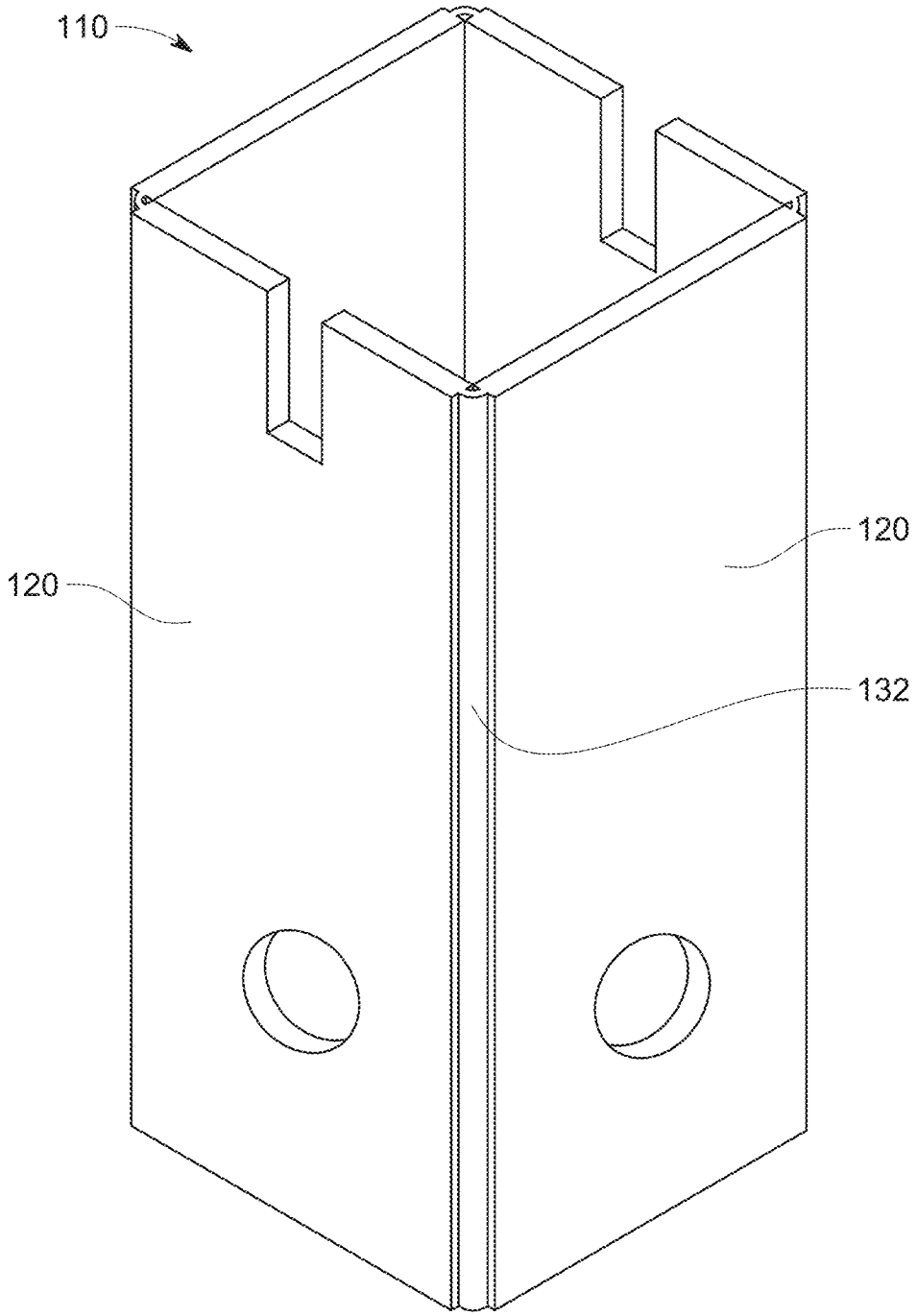
FIG. 12 illustrates an isometric view of a sixth embodiment of the base of the stand.

Referring to FIG. 12, an isometric view of a sixth embodiment of the base of the stand is shown. The base 110 is formed from a plurality of side panels 120. The edge of a side panel 120 is connected to the edge of an adjacent side panel 120 with a living hinge 132.

Figure 13:
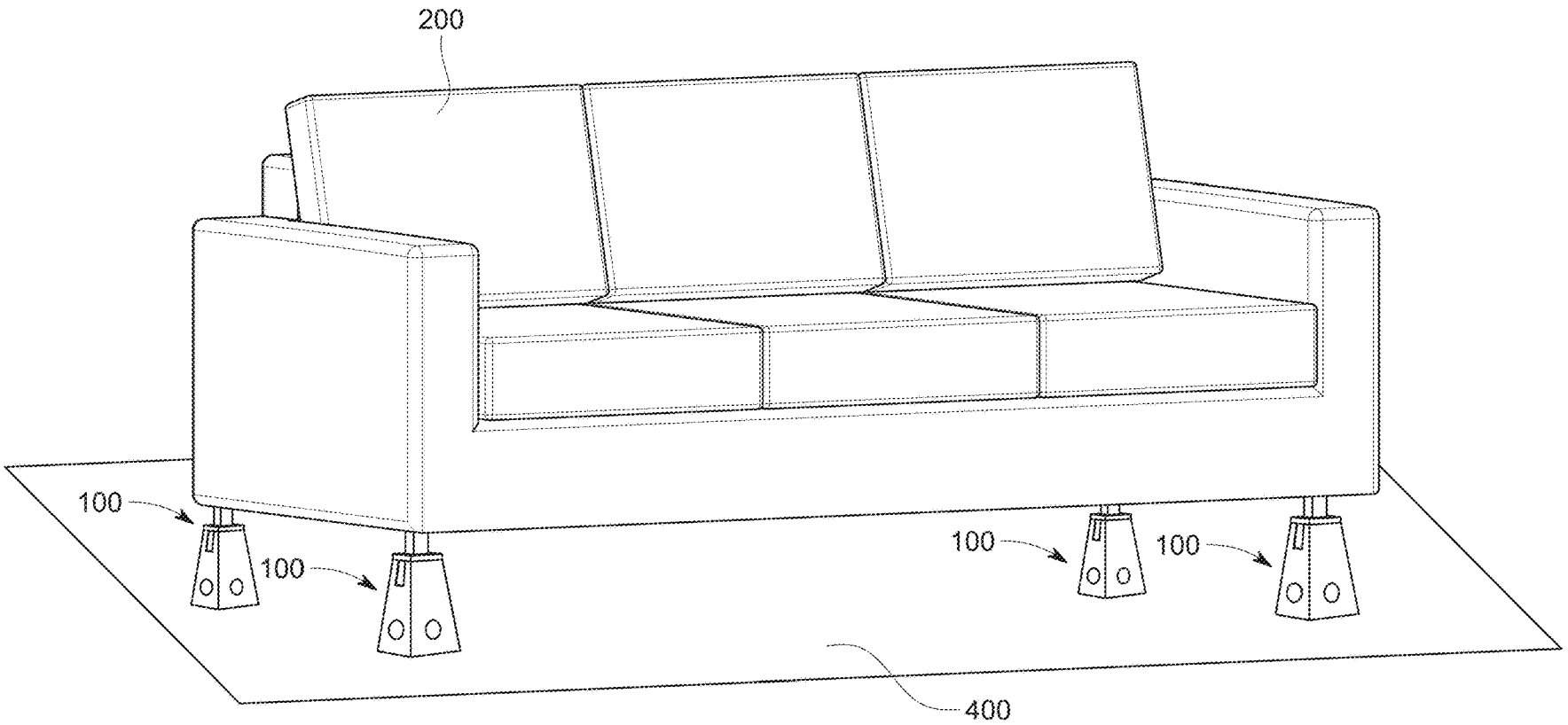
FIG. 13 illustrates a view of four stands in their supporting states supporting an object above an underlying surface.

Referring to FIG. 13, a view of four stands in their supporting states supporting an object above an underlying surface is shown. The stands 100 are in their supporting states and supporting an object 200 above an underlying surface 400.

Figure 14:
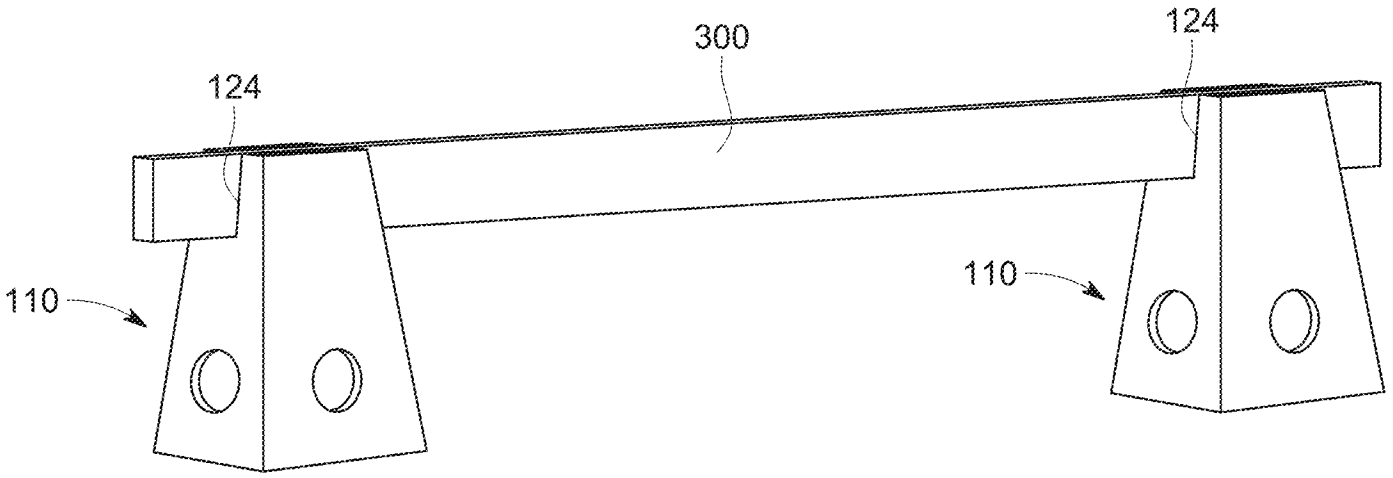
FIG. 14 illustrates a view of two bases of the stand in their supporting states with a beam positioned in the notches of the bases.

Referring to FIG. 14, a view of two bases of the stand in their supporting states with a beam positioned in the notches of the bases is shown. The bases 110 are in their supporting states with a beam 300 positioned in the notches 124 of the bases 110. The beam 300 spans a distance between a pair of bases 110.

Figure 15:
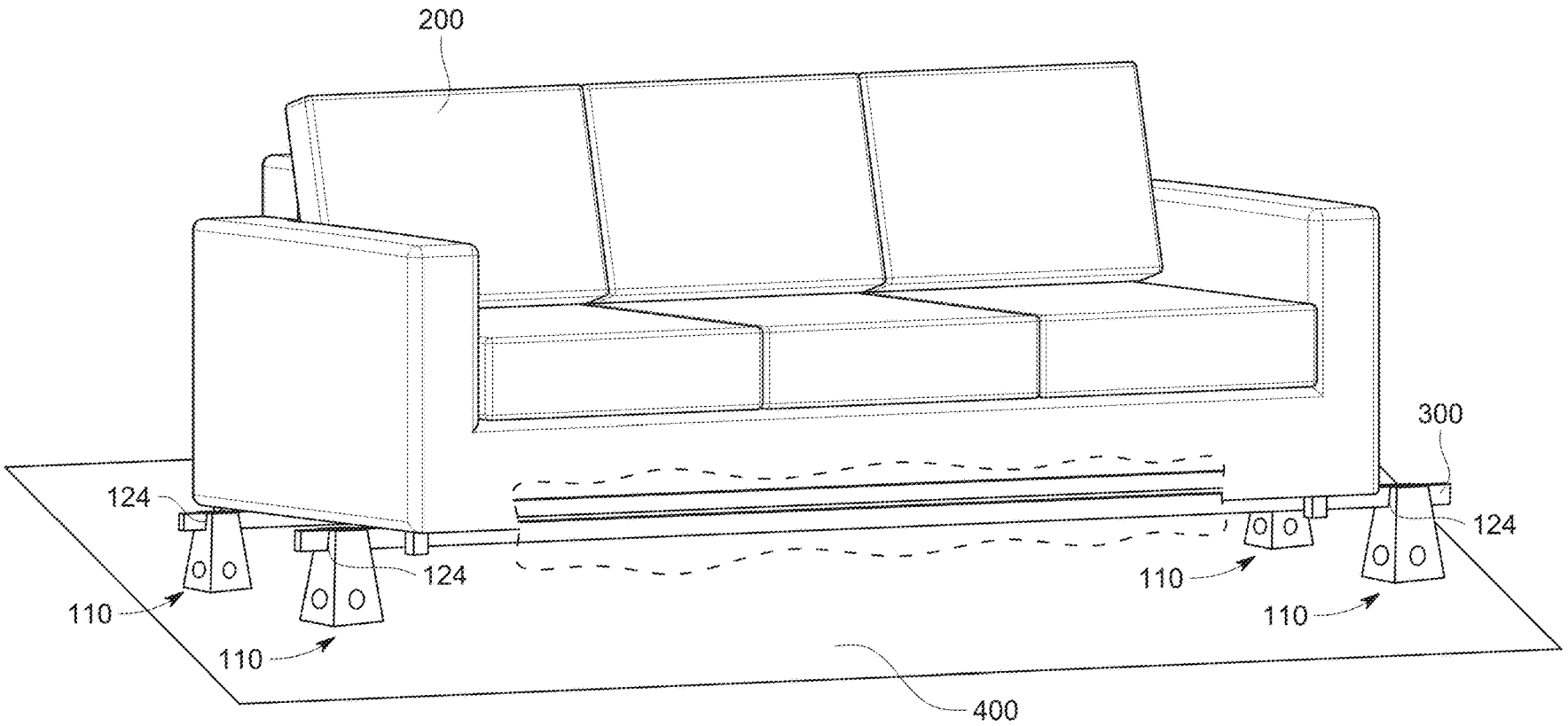
FIG. 15 illustrates a view of four bases in their supporting states with beams positioned between pairs of bases and supporting an object above an underlying surface.

Referring to FIG. 15, a view of four bases in their supporting states with beams positioned between pairs of bases and supporting an object above an underlying surface is shown. The bases 110 are in their supporting states with a beam 300 positioned in the notches 124 of the bases 110. The beam 300 spans a distance between a pair of bases 110 to support an object 200 on the beam 300 above an underlying surface 400. This configuration optionally allows for supporting larger or multiple objects 200 that extend beyond the footprint of individual bases 110, and enables efficient use of fewer bases 110 with the additional supporting surface area of the beam 300.

Equivalent elements can be substituted for the ones set forth above such that they perform in substantially the same manner in substantially the same way for achieving substantially the same result.

What is claimed is:

1. A stand comprising:

a base having a plurality of interconnected side panels movable between a collapsed state wherein the side panels are positioned substantially flat and a supporting state wherein the side panels form an upright structure having an opening in a top portion of the base; and a removable cap having at least a portion sized to fit within the opening in the top portion of the base when the base is in the supporting state, wherein the cap provides structural reinforcement to maintain the base in the supporting state and is removable to enable the base to transition to the collapsed state.

2. The stand of claim 1, wherein the base forms a truncated square pyramid shape when in the supporting state.

3. The stand of claim 1, further comprising: at least one base vent formed in at least one of the side panels, whereby the base vent allows liquid or gas to pass through the side panel of the base.

4. The stand of claim 3, wherein the base vent is sized to receive at least a portion of the cap for storage when the base is in the collapsed state.

5. The stand of claim 1, further comprising: at least one cap vent formed in the cap to allow liquid or gas to pass through the cap.

6. The stand of claim 1, further comprising: at least one notch formed at a top edge of at least one side panel.

7. The stand of claim 6, wherein the notch is configured to receive a beam positioned within the notch, whereby the beam is capable of supporting an object above an underlying surface.

8. The stand of claim 7, wherein the notch is formed at the top edge of at least two non-adjacent side panels;

at least two of the notches are configured to receive the beam positioned within the notches;

wherein placement of at least two of the notches enable the positioning of the beam to provide structural reinforcement to maintain the base in the supporting state and removal of the beam to enable the base to transition to the collapsed state.

9. A stand comprising:

a base;

the base having a plurality of side panels;

one or more hinges each connecting adjacent side panels of the plurality of side panels wherein the side panels are movable between a collapsed state and a supporting state;

the side panels being positioned substantially flat when the base is in the collapsed state;

the side panels being positioned to form an upright structure having an opening in a top portion of the base when the base is in the supporting state;

a cap;

the cap having an upper portion and a lower portion;

the lower portion of the cap configured to fit within the opening of the top portion of the base when the base is in the supporting state;

the upper portion of the cap configured to abut to a top edge of one or more of the side panels of the plurality of side panels when the base is in the supporting state; and the cap configured to be removable from the base enabling the base to transition from the supporting state to the collapsed state.

10. The stand of claim 9, wherein the one or more hinges comprise living hinges.

11. The stand of claim 9, wherein the base forms a truncated square pyramid shape when in the supporting state for supporting an object above an underlying surface, whereby the truncated square pyramid shape provides stability on the underlying surface and enables centering of a load of the object with respect to the base.

12. The stand of claim 9, further comprising: at least one base vent formed in at least one of the side panels, the base vent being an aperture configured to allow liquid or gas to pass through the side panel of the base.

13. The stand of claim 12, wherein the base vent is sized and shaped to receive at least a portion of the cap for storage of the cap on the side panel.

14. The stand of claim 9, further comprising: at least one cap vent formed in the cap, the cap vent allowing liquid or gas to pass between an interior area of the base and an exterior environment.

15. The stand of claim 9, further comprising: at least one notch formed at a top edge of at least one side panel, the notch serving as a beam-receiving recess.

16. A collapsible base for supporting an object above an underlying surface, the base comprising:

a plurality of side panels movable between a collapsed state wherein the side panels are positioned substantially flat and a supporting state wherein the side panels form an upright structure;

one or more of the side panels of the plurality of side panels having at least one notch at a top edge of the side panel; and the one or more notches configured to receive a beam positioned within the notch whereby the beam is capable of supporting an object above an underlying surface.

17. The collapsible base of claim 16, further comprising:

one or more hinges connecting side panels to enable movement between the collapsed state and the supporting state.

18. The collapsible base of claim 16, wherein the notch extends partially into a side panel of the plurality of side panels from the top edge to form a U-shaped or V-shaped recess configured to securely receive the beam.

19. The collapsible base of claim 16, wherein the notch is configured to support a beam spanning between notches of multiple bases, whereby the beam creates an extended support platform.

20. The collapsible base of claim 16, wherein the notch is formed at the top edge of at least two non-adjacent side panels;

wherein placement of at least two of the notches enable the positioning of the beam to provide structural reinforcement to maintain the base in the supporting state and removal of the beam to enable the base to transition to the collapsed state.

* * * * *